US008813910B2

(12) United States Patent
Bowden

(10) Patent No.: US 8,813,910 B2
(45) Date of Patent: Aug. 26, 2014

(54) OPERATOR CAGE WITH ENHANCED OPERATOR SAFETY

(75) Inventor: Roger Bowden, Milton Keynes (GB)

(73) Assignee: NiftyLift Limited, Milton Keynes (GB)

( * ) Notice: Subject to any disclaimer, the term of this patent is extended or adjusted under 35 U.S.C. 154(b) by 254 days.

(21) Appl. No.: 13/387,042

(22) PCT Filed: Aug. 3, 2010

(86) PCT No.: PCT/GB2010/001468

§ 371 (c)(1),
(2), (4) Date: Mar. 5, 2012

(87) PCT Pub. No.: WO2011/015815

PCT Pub. Date: Feb. 10, 2011

(65) Prior Publication Data

US 2012/0152653 A1 Jun. 21, 2012

(30) Foreign Application Priority Data

Aug. 7, 2009 (GB) ..... 0913772.0

(51) Int. Cl.
*B66F 11/04* (2006.01)

(52) U.S. Cl.
CPC ..... *B66F 11/044* (2013.01)
USPC ..... 182/19; 182/18

(58) Field of Classification Search
USPC ..... 182/19, 18
See application file for complete search history.

(56) References Cited

U.S. PATENT DOCUMENTS

| | | | | |
|---|---|---|---|---|
| 4,016,535 | A | 4/1977 | Dinlocker | |
| 4,979,588 | A | 12/1990 | Pike et al. | |
| 6,145,619 | A | 11/2000 | Risser | |
| 6,571,913 | B2 * | 6/2003 | Puszkiewicz et al. | 182/69.1 |
| 2006/0113122 | A1 * | 6/2006 | Persson | 180/19.1 |

FOREIGN PATENT DOCUMENTS

| | | | |
|---|---|---|---|
| CN | 2 934 193 | Y | 8/2007 |
| EP | 1923347 | A1 | 5/2008 |
| GB | 2457908 | | 2/2009 |
| JP | 2001226097 | A * | 8/2001 |
| JP | 2002114500 | A * | 4/2002 |
| KR | 20090002074 | U | 3/2009 |
| WO | WO 2009/037429 | | 3/2009 |

OTHER PUBLICATIONS

International Search Report issued in PCT/GB2010/001468 mailed Nov. 30, 2010.
Search Report issued in GB 0913772.0 dated Dec. 7, 2009.

* cited by examiner

*Primary Examiner* — Alvin Chin-Shue
(74) *Attorney, Agent, or Firm* — Knobbe Martens Olson & Bear LLP

(57) ABSTRACT

An operator cage (6) for a machine such as a mobile elevating work platform comprises a base unit (22) and a fence assembly (25), a control console (32) and a load sensor (46) that is constructed and arranged to sense an external load applied to the console. The console (32) is mounted for pivoting movement and the load sensor (46) is constructed and arranged to detect movement of the console from an unloaded condition to a loaded condition.

7 Claims, 5 Drawing Sheets

OPERATOR CAGE WITH ENHANCED OPERATOR SAFETY

RELATED APPLICATIONS

The instant application is the U.S. National Phase under 35 U.S.C. §371 of International Application No. PCT/GB2010/001468 entitled OPERATOR CAGE WITH ENHANCED OPERATOR SAFETY, filed Aug. 3, 2010, designating the U.S. which claims priority under 35 U.S.C §119(a)-(d) to Great Britain Patent Application No. 0913772.0, filed Aug. 7, 2009, the content of which are herein incorporated by reference in its entirety.

FIELD OF THE INVENTION

The present invention relates to an operator cage for a machine, and in particular but not exclusively for a mobile elevating work platform (MEWP). The operator cage may also be used with other machines such as forklifts or telescopic handling machines ("telehandlers"), or provided as an attachment for use with such machines. The invention also relates to an elevating work platform having an operator cage.

BACKGROUND OF THE INVENTION

An elevating work platform conventionally consists of a base, an extending structure (for example a boom or other lifting structure) mounted on the base that may be articulated and/or telescopic, and an operator cage that is attached to the end of the extending structure. The operator cage provides the operator with an enclosed and protected area in which to stand while operating the machine. The cage also provides the operator with a platform from which to work when the cage is elevated. The base may be either static or mobile.

A safety hazard can occur both during operation of the platform and also when a MEWP is driven, as the operator may not notice an overhead obstruction and may be pressed against the control console, which in turn could lead to injury or death. Similar risks may also arise in other machines, for example telehandlers and forklifts, in which an operator cage is fitted as an attachment to the load-bearing forks.

An operator cage system that addresses this safety issue is described in international patent application WO2009/037429A, in which the control console is protected by a system that detects a force applied to the console or a handrail or support in the vicinity of the console. If the operator is pressed against the console, this activates a safety switch, which in turn interrupts the drive system of the lifting mechanism (and, if applicable, of the wheels) to prevent further movement of the cage, thus avoiding serious injury to the operator. However, a negligent operator may also be tempted to try to override the system by disconnecting the safety switch or jamming an object underneath the handrail or support to prevent it from being activated.

Other safety systems are known that use a mechanical obstruction sensor. However, as this sensor is obvious in the sense that it can be easily seen by the operator, this may encourage the operator to act carelessly, thinking that the system will protect him from accidents.

It is an object of the present invention to provide an operator cage that mitigates at least some of the aforesaid disadvantages.

SUMMARY OF THE INVENTION

According to one aspect of the present invention there is provided an operator cage for a machine, the cage comprising a base unit, a fence assembly, a control console and a load sensor that is constructed and arranged to sense an external load applied to the console, wherein the console is mounted for pivoting movement, and the load sensor is constructed and arranged to detect movement of the console from an unloaded condition to a loaded condition.

The load sensor senses external loads applied to the console. The sensor can help to protect the operator from danger in the event that the operator cage collides with an obstruction. The safety system is essentially covert, in the sense that it is not immediately obvious to an operator that the system is present. This reduces the chance that the operator will take less care when operating the machine. Furthermore, because the console can be formed as a one-piece unit, it is robust and simple to manufacture.

Advantageously, the operator cage includes resilient biasing means that is constructed and arranged to bias the console towards the unloaded condition. This ensures that the safety system is not triggered by ordinary loads encountered during normal usage and only comes into operation when crush loads are present. The amount of pre-load applied to the console by the biasing means can preferably be adjusted according to the circumstances of use.

Advantageously, the console is constructed and arranged to be displaced from the unloaded condition only when the external load exceeds a predetermined value.

Advantageously, the load sensor includes a proximity switch.

Advantageously, the switch is normally closed. This provides for fail-safe operation, whereby operation of the machine is prevented if the switch fails or is missing. Alternatively, failure of a load sensor may cause the system to report a failure condition by visual and/or audible means and allow normal machine operation.

Advantageously, the load sensor is located within a closed compartment, to prevent unauthorised tampering.

The operator cage may include control means for controlling or restricting operation of the machine when the load sensor senses an external load applied to the console.

Optionally, the cage may also include a crush sensor that is constructed and arranged to sense external crush forces applied to an upper portion of the fence assembly.

Advantageously, the fence assembly includes an upper rail having a first portion that is positioned at a first height above the base unit and a second portion that is positioned at a second height above the base unit, wherein the second height is greater than the first height and the second portion is located above a gateway providing access to the operator cage. The raised second portion of the upper rail allows easier access to the operator cage through the gateway.

Preferably, the gateway includes a hinged gate below the second portion of the upper rail, wherein one end of the gate is mounted for pivoting movement and the other end is constructed and arranged to be retained by the fence assembly throughout its movement.

The raised second portion of the rail also serves as a guard that helps to protect an operator from injury when operating the machine. For example, if a conventional MEWP is driven backwards, the operator may not see an obstacle and may be pressed against the control console. The raised portion of the rail helps to protect the operator from colliding with the obstacle. The second portion may support one or more proximity sensors and/or crush sensors.

According to another aspect of the present invention there is provided a machine comprising a base, an extending structure and an operator cage attached to the extending structure, wherein the operator cage is as defined by any one of the preceding statements of invention, or any combination thereof.

Various embodiments of the invention will now be described, by way of example, with reference to the accompanying drawings, in which:

DETAILED DESCRIPTION OF THE PREFERRED EMBODIMENT

Figure 1:
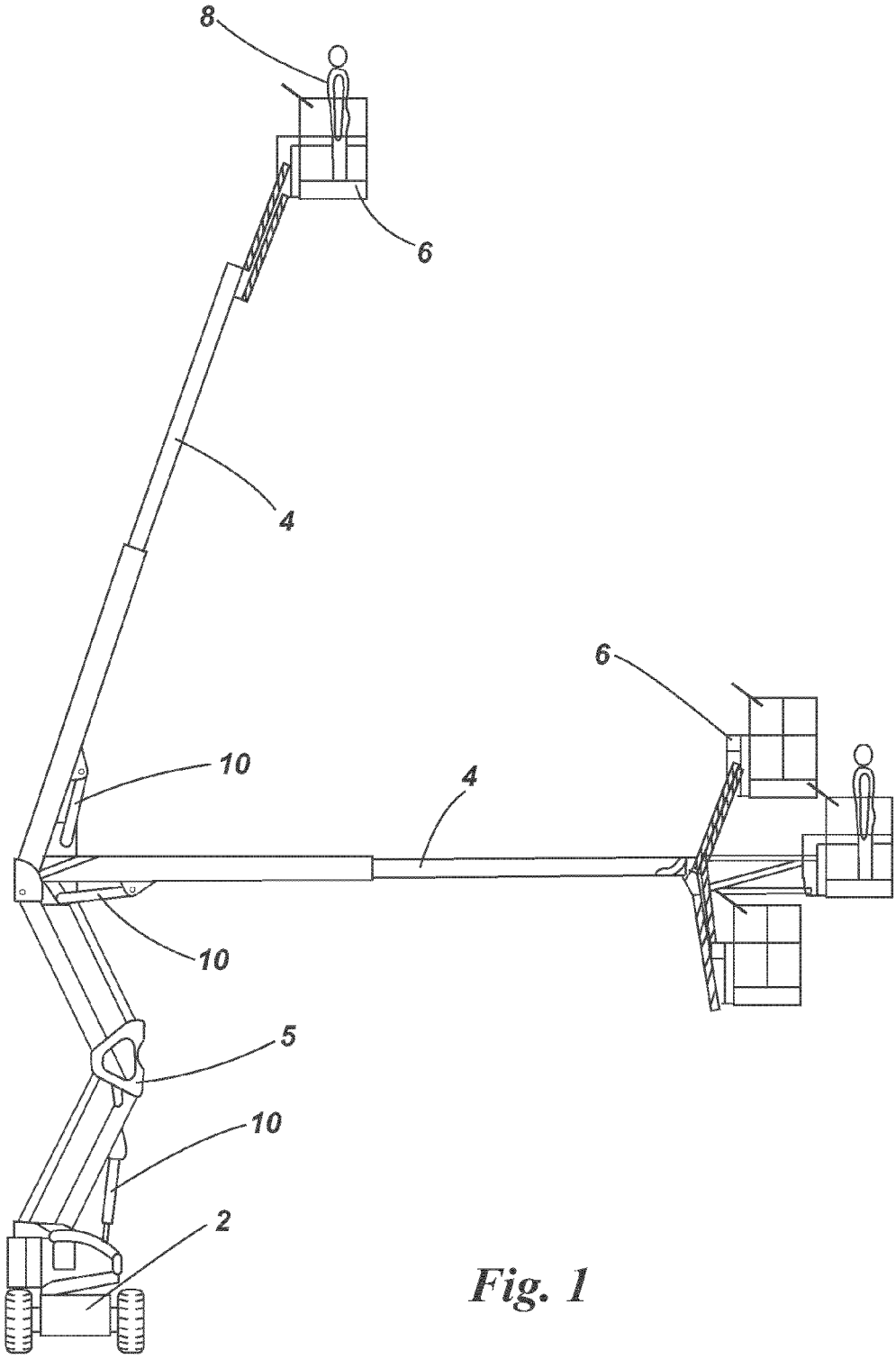
FIG. 1 is an end view of a typical mobile elevating work platform.

FIG. 1 shows a typical mobile elevating work platform, which includes a wheeled base 2, a hydraulically operated extending structure comprising a boom 4 and a lifting structure 5, and a cage 6 for a human operator 8. The boom 4, which is shown here in two different operating configurations, may be retracted and folded onto the wheeled base 2 for transportation or storage. Movement of the boom is controlled by various hydraulic cylinders 10, which are connected to a hydraulic drive system (not shown). Hydraulic motors may also be provided for driving the wheels of the wheeled base 2.

Apart from the operator cage 6, the components shown in FIG. 1 are all conventional and will not therefore be described in detail. It should be understood that the mobile elevating work platform may take various alternative forms.

Figure 2:
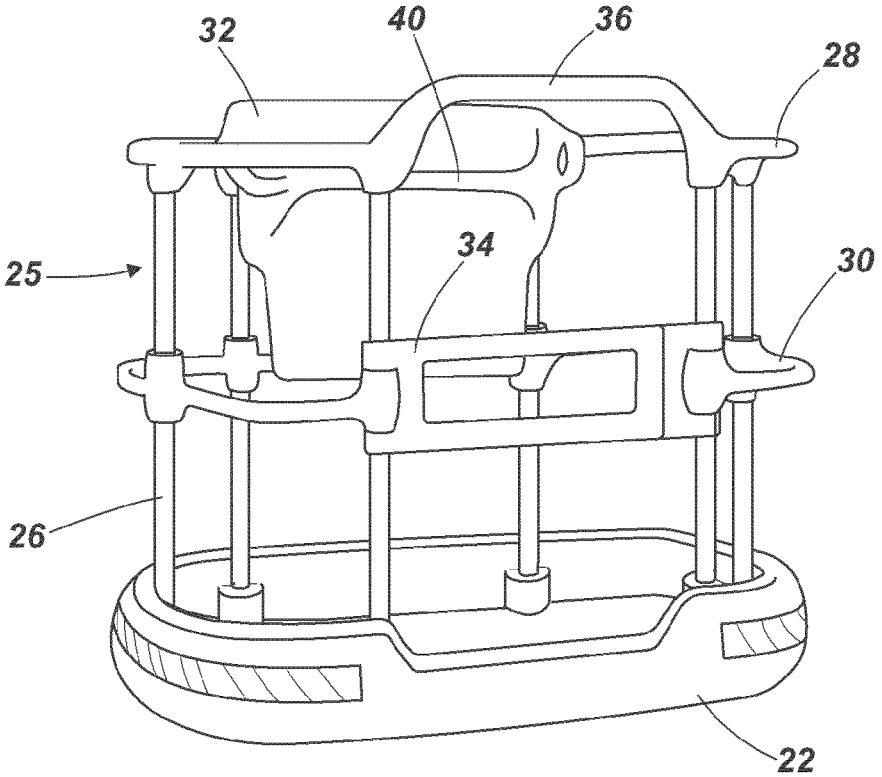
FIG. 2 is a perspective view of an operator cage.

The operator cage 6 shown in FIG. 2 includes a substantially rectangular base unit 22, a fence assembly 25 comprising six upright support posts 26, an upper guard rail 28 and a lower guard rail 30, and a control console 32. The lower guard rail 30 incorporates a gate 34 that allows access to the operator cage.

The base unit 22 and the control console 32 are preferably moulded plastic or composite components. The fence assembly 25 is preferably made of metal, for example welded steel or cast aluminium. Alternatively, the fence structure may be made of plastics or a composite material. The upper guard rail 28 includes an entry portion 36 that is raised to allow easy access to the cage. The raised portion 36 of the upper guard rail also provides protection from overhead obstructions while reversing.

The control console 32 preferably includes an integral hand rail 40 that extends across the front of the console and provides a barrier between the operator and the controls. This hand rail 40 provides the operator 8 with a support that he or she can hold to avoid overbalancing when manoeuvring the cage 6. This helps to prevent inadvertent operation of the controls if the operator reaches for support when overbalancing.

The console 32 carries the controls (not shown) for the MEWP drive system, which control movement of the lifting structure and, if appropriate, of the wheels. The console is made as a single part moulding from a plastic or composite material. It is attached to the upper and lower guard rails in the front portion of the operator cage.

Figure 3:
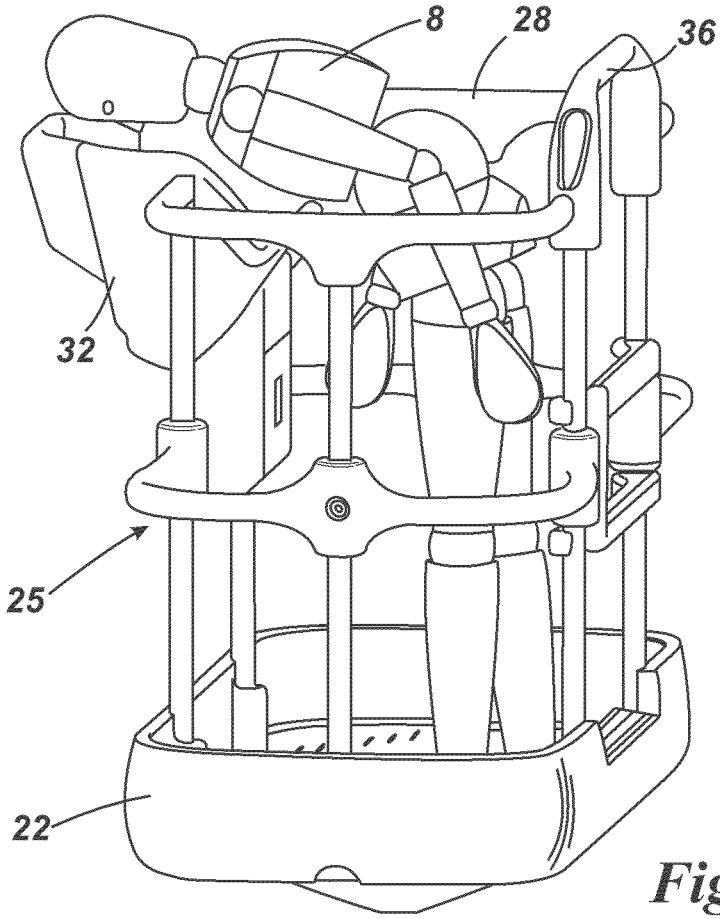
FIG. 3 is a perspective view of the operator cage in use, illustrating a hazardous situation.
Figure 4:
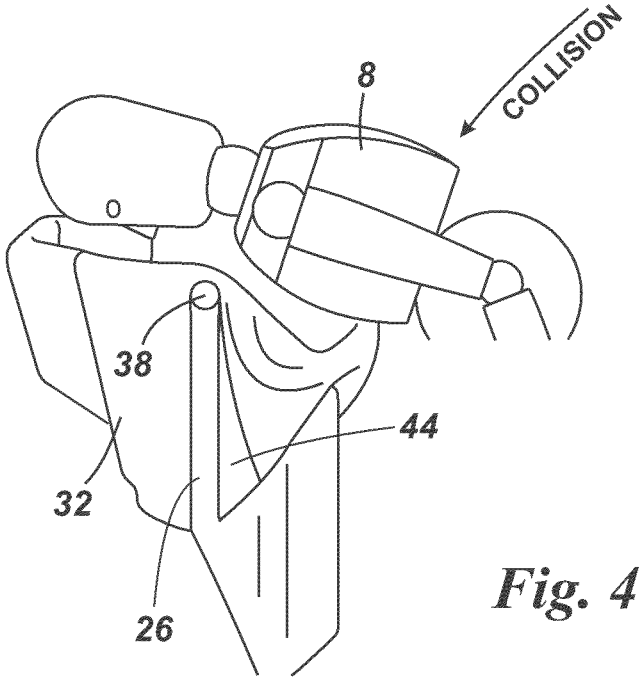
FIG. 4 is a perspective view at an enlarged scale showing part of the operator cage in use.
Figure 5:
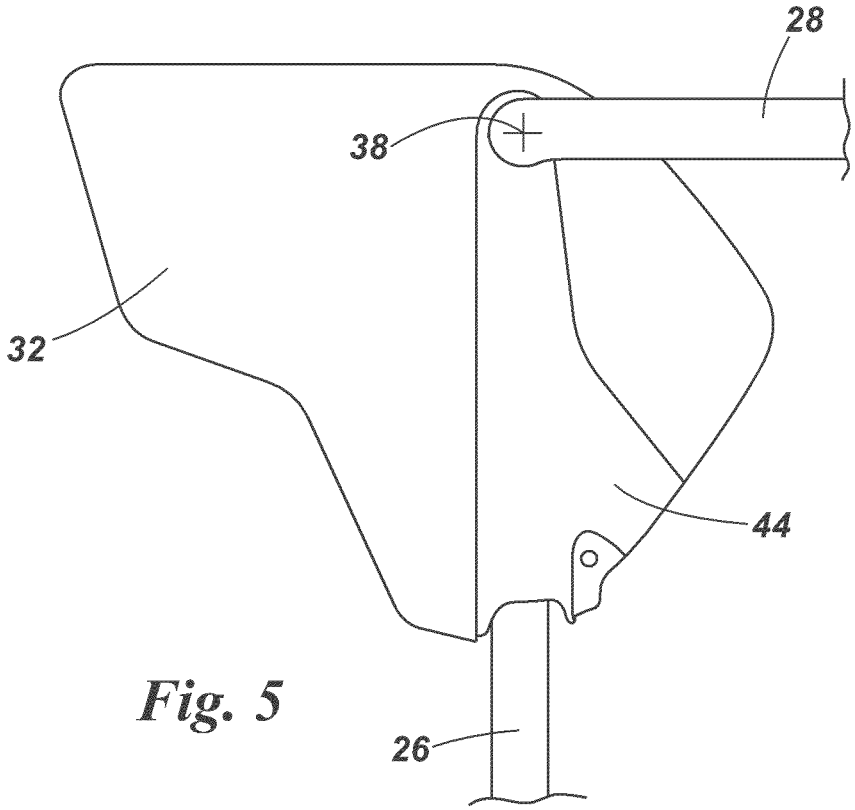
FIG. 5 is a side view at an enlarged scale of a control console.
Figure 6:
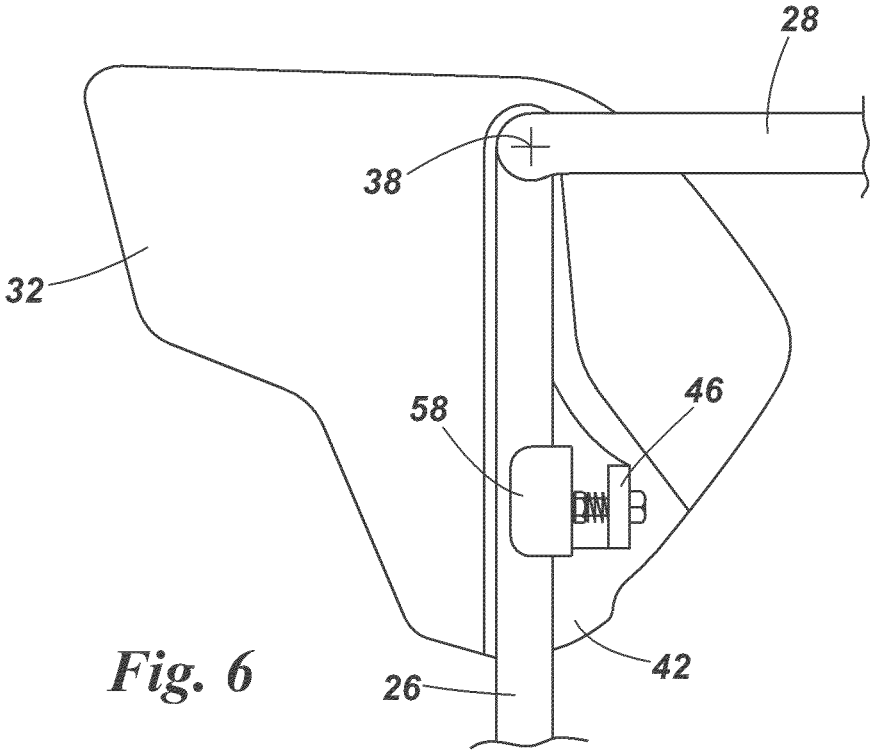
FIG. 6 is a side view of the control console with a side cover removed.

As shown in FIGS. 3 to 10, the console 32 includes a load sensor for sensing external crush forces applied to the console, as may be caused for example by a collision between an obstruction (not shown) and the operator 8. Such a situation might arise for example when the operator cage 6 is being manoeuvred or driven backwards, if the operator 8 does not see the obstruction. As a result, the operator 8 might be trapped between the obstruction and the control console 32 as illustrated in FIGS. 3 and 4. This might cause a serious risk of injury, particularly if the operator 8 is trapped in a position that actuates the controls, causing the operator cage 6 to be manoeuvred further towards the obstruction.

In this embodiment, the control console 32 is supported by the upper guard rail 28 of the fence assembly 25 and is constructed and arranged for limited pivoting movement around the guard rail, which acts as a pivot 38 for the console. In order to allow for this pivoting movement, recesses 42 are provided in both sides of the console 32, which accommodate the vertical support posts 26 on either side of the console. These recesses 42 and the upper parts of the support posts 26 are normally hidden from view by removable cover plates 44.

Figure 8:
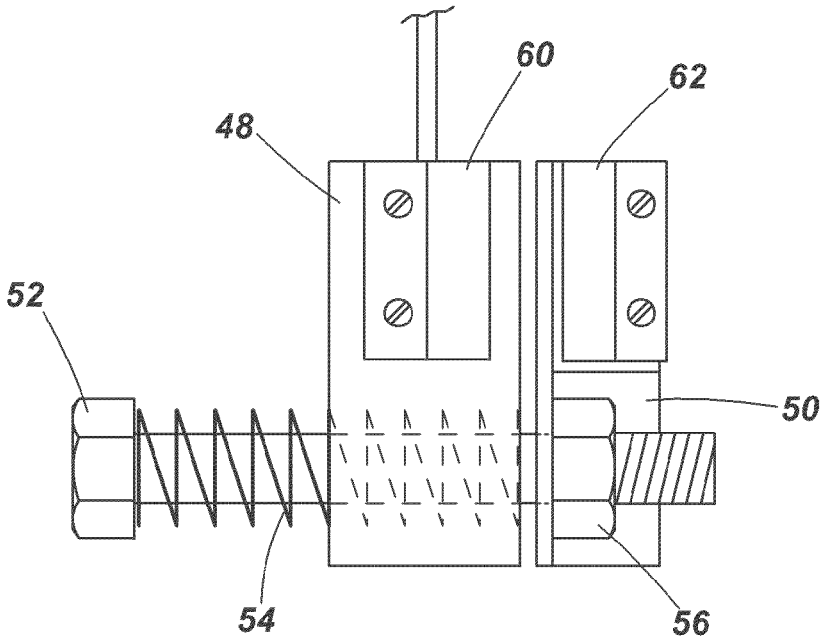
FIG. 8 is a side view at an enlarged scale of a sensing device for the control console.
Figure 9:
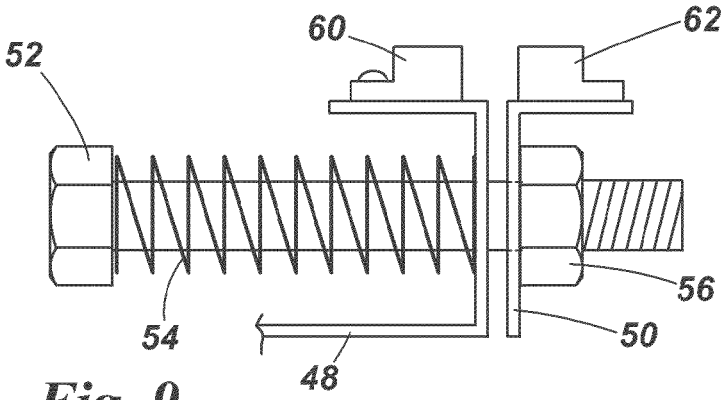
FIGS. 9 and 10 are plan views of the sensing device in unloaded and loaded conditions respectively.
Figure 10:
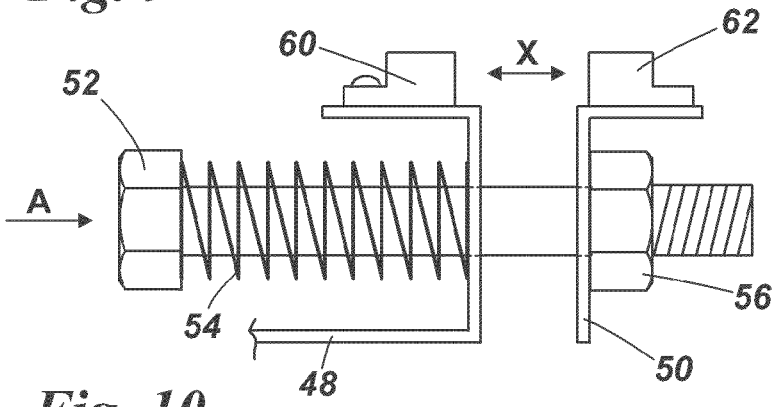

Each recess 42 also accommodates a sensing device 46, one of which is shown in more detail in FIGS. 8-10. The sensing device 46 includes a first bracket 48 that is attached to the console 32 and a second bracket 50 that is attached to the first bracket 48 by a bolt 52 that passes through aligned holes in the brackets and extends outwards on the free side of the first bracket 48. Bracket 50 is prevented from rotating by a stabilising bar (not shown) that is fixed to one bracket and slides within a bush/bearing surface (not shown) that is fixed to the other bracket. The other end of the bolt 52 is received in a thread in the second bracket 50 that is provided, for example, by a nut 56 that is fixed (for example welded) to the second bracket 50. A spring 54 is compressed between the head of the bolt 52 and the first bracket 48, so that the second bracket 50 is drawn towards the first bracket 48. The spring 54 thus urges the two brackets towards one another as shown in FIGS. 8 and 9 with a resilient biasing force that depends on the compression of the spring 54. This biasing force can be adjusted by rotating the bolt 52. Preferably, bolt 52 is selected such that when it is wound to the end of its thread the spring 54 is not over compressed. Preferably, the desired biasing force is achieved when the bolt 52 is wound to the end of its thread. The head of the bolt 52 presses against a striker plate 58 that is attached to one of the cage posts 26. This maintains the control console 32 in the upright position shown in FIGS. 5 and 6.

Figure 7:
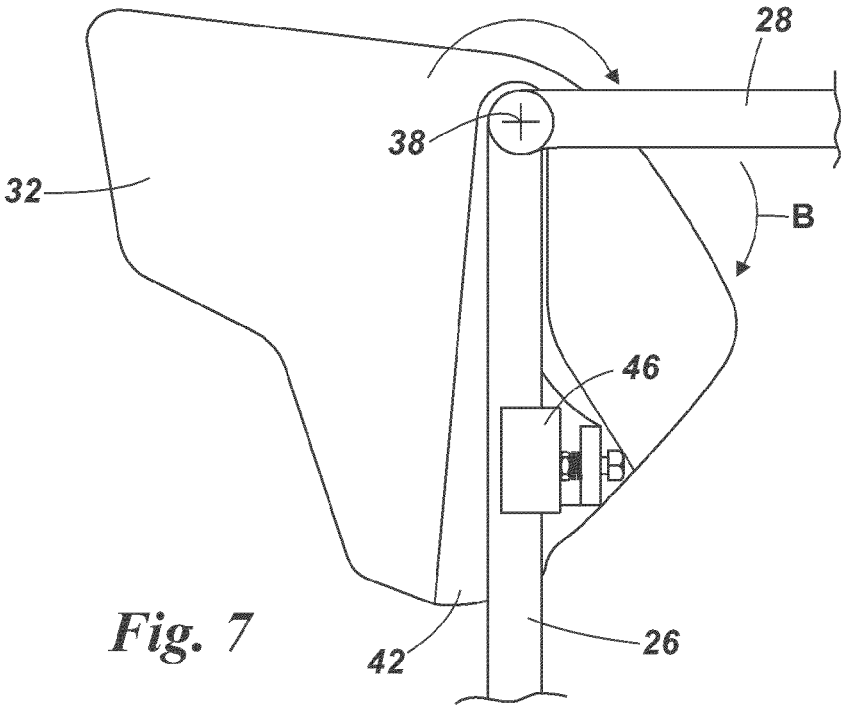
FIG. 7 is a side view of the control console in a loaded condition.

If a force A is applied to the bolt 52 via the striker plate 58, this can cause the separation X of the two mounting brackets 48, 50 to increase as shown in FIG. 10, but only if the force A is greater than the biasing force exerted by the spring 54. This can occur if a large downwards load B is applied to the control console 32 at or near its front edge, as shown in FIG. 7. This causes the console 32 to rotate about the pivot 38 to the tilted position shown in that drawing. When the load B is removed, the console will return under the influence of the springs 54 to the unloaded condition shown in FIGS. 5, 6, 8 and 9.

The sensing device 46 includes a proximity switch 60 or similar sensor that is constructed and arranged to detect movement of the console 32 from the unloaded condition shown in FIGS. 5, 6, 8 and 9 to the loaded condition shown in FIGS. 7 and 10. The proximity switch or sensor is connected to the control system of the MEWP, which is arranged to interrupt the drive system for the work platform to prevent further movement of the platform if the console is in the loaded condition.

In this embodiment, the proximity switch 60 comprises a reed switch attached to the first bracket 48, which is influenced by a magnet 62 that is attached to the second bracket 50. When the control console 32 is unloaded, the reed switch 60 is in a first state allowing the drive system of the platform to be operated. However, when the console 32 is loaded, for example when an operator is trapped against the console, the magnet 62 is displaced away from the reed switch 60 and the switch changes to a second state, disabling the drive system. In this situation, drive can only be restored by removing the load from the console 32 so that it returns to its normal unloaded condition and then resetting the system, or by using an over-ride control.

Preferably the proximity switches 60 will be in a normally closed (N/C) state when the console is unloaded and in a normally open (N/O) state when the console is loaded. This adds an extra level of safety because in the event that a switch is broken or removed, the system will act in the same way as if the magnet had moved away from the proximity switch: that is it will stop the machine.

The switch/sensor may provide feedback, for example by means of a light on the control panel, to inform the operator as to what state/condition the switch is in, for example loaded, unloaded, working or not working.

Alternatively other types of switch may be used, for example push buttons or cam activated micro-switches. Alternatively, switches may be located in other positions for example fixed to the cage post. Other types of springs and pre-loads could also be used, for example torsion springs that are assembled around the pivot point of the console.

The sensing system 46 is completely covered by the cover plates 44, making it covert (that is, hidden from view). This reduces the chance of operator complacency and makes the system more difficult to over-ride. Assembling the covers using security screws can reduce this risk further. Covering the sensing system also prevents entanglement, snagging, and the risk of finger trapping.

Alternatively the covers could be manufactured in a bright colour, making it obvious to the operator that the system is installed.

During operation, the control console 32 is biased upwards by the compression springs 54. However, if a sufficient downwards force is applied to the console in the direction of arrow B, the bias force of the springs 54 can be overcome allowing the console to activate one or both of the sensor switches 60. The switches 60 are connected to a control device (not shown) that controls or restricts operation of the machine when either of the switches is activated. The downward movement of the console 32 also helps to relieve the crushing force felt by the operator 8, while the handrail maintains a barrier between the operator and the controls.

Therefore, if the operator 8 is pressed against the control console 32 as shown in FIGS. 3 and 4, the load sensor 46 senses the external crushing force and activates the control device, which then prevents further movement of the cage 6. The control device may include an override control, which allows limited movement of the cage after activation, for example allowing the cage to be moved away from the obstruction. Generally, any such movement will be restricted to a very low speed. The control device may also actuate a visual and/or audible alarm. It may also include a reset control, allowing normal operation to be resumed after the crushing force has been removed.

Alternatively, pressure sensors or strain gauges may be provided to sense an excessive crush force applied to the console or to a hand rail or support connected to the console.

A crush sensor may also be provided elsewhere on the cage, for example on the raised portion 36 at the rear of the upper guard rail 28. Alternatively or additionally, one or more ultrasonic proximity sensors may be mounted on the cage to provide a warning and/or to control or restrict movement of the cage if it comes into close proximity with an obstacle.

The operator cage or features thereof may also be used or designed for use with various types of machine other than mobile elevating work platforms, either as an original feature or as a retrofit option. For example, the operator cage may be designed for use with machines such as telescopic handling machines ("telehandlers") or other machines where an operator cage is provided to accommodate (and generally protect) the operator.

The invention claimed is:

1. An operator cage for a machine, the cage comprising a base unit, a fence assembly including a guard rail, and a vertical support post, a control console and a load sensor that is constructed and arranged to sense an external load applied to the console, wherein the console is mounted on the guard rail for pivoting movement about the guard rail, and the load sensor is mounted on the support post, and is constructed and arranged to detect pivoting movement of the console about the guard rail from an unloaded condition to a loaded condition, and resilient biasing means that is constructed and arranged to bias the console with a predetermined biasing force towards the unloaded condition, wherein the console is constructed and arranged to be displaced from the unloaded condition to the loaded condition only when the external load applied to the control console exceeds the predetermined biasing force.

2. An operator cage according to claim 1, wherein the load sensor includes a proximity switch.

3. An operator cage according to claim 2, wherein the switch is in a normally closed condition when the console is unloaded and a normally open condition when the console is loaded.

4. An operator cage according to claim 1, wherein the load sensor is located within a substantially closed compartment.

5. An operator cage according to claim 1, wherein the guard rail has a first portion that is positioned at a first height above the base unit and a second portion that is positioned at a second height above the base unit, wherein the second height is greater than the first height and the second portion is located above a gateway providing access to the operator cage.

6. An operator cage according to claim 5, wherein the gateway includes a hinged gate below the second portion of the guard rail, wherein one end of the gate is mounted for pivoting movement and the other end is constructed and arranged to be retained by the fence assembly throughout its movement.

7. A machine comprising a base, an extending structure and an operator cage according to claim 1 attached to the extending structure.

* * * * *